US009101173B1

(12) United States Patent
Loomis et al.

(10) Patent No.: US 9,101,173 B1
(45) Date of Patent: Aug. 11, 2015

(54) ARTIFICIAL TREE APPARATUS ADAPTED FOR BEING RELEASABLY SECURED IN A STOWED POSITION

(71) Applicants: Jason Loomis, Decatur, GA (US); Nash Rittmann, Odessa, FL (US); Yi Xin Long, Jiangmen (CN)

(72) Inventors: Jason Loomis, Decatur, GA (US); Nash Rittmann, Odessa, FL (US); Yi Xin Long, Jiangmen (CN)

(73) Assignee: Seasons 4 Light Inc., Toano, VA (US)

( * ) Notice: Subject to any disclaimer, the term of this patent is extended or adjusted under 35 U.S.C. 154(b) by 103 days.

(21) Appl. No.: 13/844,957

(22) Filed: Mar. 16, 2013

Related U.S. Application Data

(60) Provisional application No. 61/613,092, filed on Mar. 20, 2012.

(51) Int. Cl.
*A47G 33/06* (2006.01)
*A41G 1/00* (2006.01)

(52) U.S. Cl.
CPC ..... *A41G 1/007* (2013.01); *A47G 33/06* (2013.01)

(58) Field of Classification Search
CPC ..... A47G 33/06; A41G 1/007; D06F 57/04
USPC ..... 428/8, 18, 19, 20; 74/534, 541; 47/22.1, 47/23.2; 248/68.1; 211/117, 118, 190; 135/23
See application file for complete search history.

(56) References Cited

U.S. PATENT DOCUMENTS 4,140,823 A * 2/1979 Weskamp ..... 428/9
7,267,852 B1 * 9/2007 Rosado et al. ..... 428/20

OTHER PUBLICATIONS

Integrity Land Works, "Large Plants Mean Large Transplants", 2010, p. 1-14; http://integritylandworks.com/large-plants-mean-large-trans-plants/.*

* cited by examiner

*Primary Examiner* — Mark Ruthkosky
*Assistant Examiner* — Julia L Rummel
(74) *Attorney, Agent, or Firm* — Craige Thompson; Thompson Patent Law

(57) ABSTRACT

Apparatus and associated methods may relate to an artificial tree apparatus having a plurality of branch segments hingedly connected to a trunk segment and adapted to be releasably secured in a stowed position. In an illustrative example, the branch segments may be secured in the stowed position by cinching a control member. For example, each branch segment may include a control member guide having an aperture, wherein the control member may be routed through the apertures of the control member guides for a given layer of branch segments. As the control member is cinched, the branch segments may be hinged inwardly to the stowed position. In an exemplary embodiment, the control member may include a releasable securing apparatus for retaining the branch segments in the stowed position. Releasing the control member from the cinched position may permit the branch segments to freely hinge outwardly to a deployed position.

12 Claims, 7 Drawing Sheets

ARTIFICIAL TREE APPARATUS ADAPTED FOR BEING RELEASABLY SECURED IN A STOWED POSITION

CROSS-REFERENCE TO RELATED APPLICATIONS

This application claims the benefit under Title 35, United States Code, Section 119(e) of U.S. provisional patent application Ser. No. 61/613,092 filed Mar. 20, 2012. The 61/613,092 application is hereby incorporated by reference into this application.

TECHNICAL FIELD

Various embodiments relate generally to artificial trees, and more particularly to a mechanism for releasably securing a plurality of branch segments of an artificial tree in a stowed position.

BACKGROUND

It has become commonplace in both residential and commercial environments to incorporate plants in both indoor and outdoor spaces. Plants can serve various useful purposes, such as for example, providing decoration both for everyday and holiday occasions, as well as creating a more relaxing environment through actual and placebic effects of the plant. In cases where a live plant cannot or is preferred not to be used, artificial plants or trees can be a popular choice, such as for instance during holiday seasons. After the holiday season, the artificial tree is generally disassembled and/or moved to a storage location. Because of the large stature of the trees, disassembling and/or moving the artificial trees to a storage location can be cumbersome.

SUMMARY

Apparatus and associated methods may relate to an artificial tree apparatus having a plurality of branch segments hingedbly connected to a trunk segment and adapted to be releasably secured in a stowed position. In an illustrative example, the branch segments may be secured in the stowed position by cinching a control member. For example, each branch segment may include a control member guide having an aperture, wherein the control member may be routed through the apertures of the control member guides for a given layer of branch segments. As the control member is cinched, the branch segments may be hinged inwardly to the stowed position. In an exemplary embodiment, the control member may include a releasable securing apparatus for retaining the branch segments in the stowed position. Releasing the control member from the cinched position may permit the branch segments to freely hinge outwardly to a deployed position.

In accordance with an exemplary embodiment, the control member may be located within a common horizontal plane as the associated control member guides. For example, the control member guides and the control member may be located along the same lengthwise portion of the branch segment to be in a common horizontal plane and at a common radius or distance from the trunk segment. In some exemplary embodiments, the control member guides may be located at mid-length location along the branch segment. In some exemplary embodiments, the control member guides may be located adjacent a proximal or distal end of the branch segments. In an illustrative example, each control member guide within a given layer of branch segments is located at a similar location along the length of the respective branch segment.

In some implementations, the control member guides may be integrally formed with the branch segments, such as for example during a manufacturing process. In other exemplary embodiments, the control member guides may be releasably connected to a pre-existing branch segment. In some exemplary embodiments, the securing apparatus may be formed in the shape of a hook to be releasably connected to a control member guide for retaining the control member in the cinched state. In other exemplary embodiments, the securing apparatus may be formed of a spring-loaded clip or clasp. In other exemplary embodiments, the control member may be formed of a zip-tie structure.

Various embodiments may achieve one or more advantages. For example, some embodiments may permit for an artificial tree apparatus to be quickly altered to a storage or stowed position from a deployed position. In some implementations, cinching the branch segments in an inwardly hinged position may permit for a decrease in required storage space for the artificial tree apparatus. In other implementations, cinching the branch segments in an inwardly hinged position may permit for a decrease in required transport space for transporting the artificial tree apparatus. In other exemplary embodiments, being able to quickly move the branch segments to a stowed position or a deployed position may increase employee productivity, such as for example when the artificial tree apparatus is used for display purposes in a business environment.

The details of various embodiments are set forth in the accompanying drawings and the description below. Other features and advantages will be apparent from the description and drawings, and from the claims.

BRIEF DESCRIPTION OF THE DRAWINGS

Like reference symbols in the various drawings indicate like elements.

DETAILED DESCRIPTION OF ILLUSTRATIVE EMBODIMENTS

Figure 6:
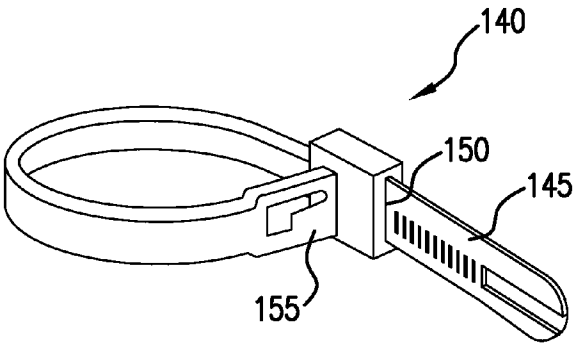
FIG. 6 depicts a second exemplary control member.
Figure 7:
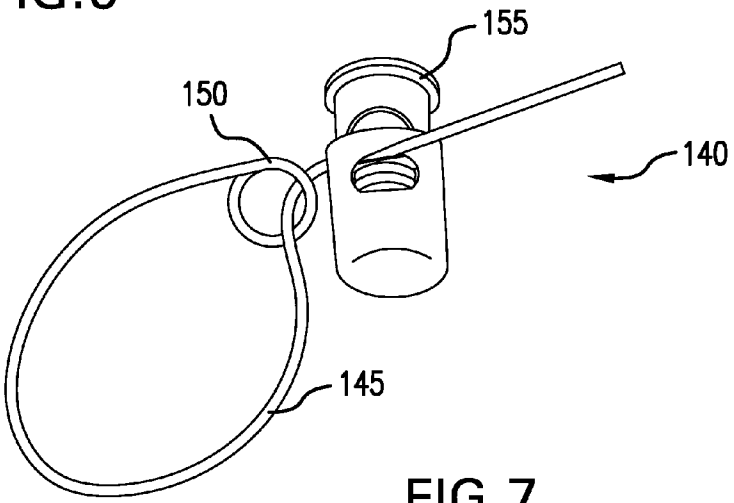
FIG. 7 depicts a third exemplary control member.

To aid understanding, this document is organized as follows. First, an exemplary artificial tree apparatus for retaining a plurality of branch segments in a stowed position is briefly introduced with reference to FIGS. 1A-1B. Second, with reference to FIGS. 2A-2B an exemplary tree segment from the artificial tree apparatus is illustrated in the deployed and stowed positions. Next, the discussion turns to exemplary embodiments that illustrate the control member guide extending from the branch segment. Specifically, FIGS. 3A-3B detail the control member guide integrally formed with the branch segment and FIG. 4 details the control member guide removably connected to the branch segment. Then, FIGS. 5-7 illustrate a variety of control members for use with the artificial tree apparatus to retain the branch segments in the stowed position. Finally, with reference to FIG. 8, further explanatory discussion and experimental data is presented to explain improvements in moving the branch segments to the stowed position.

Figure 1A:
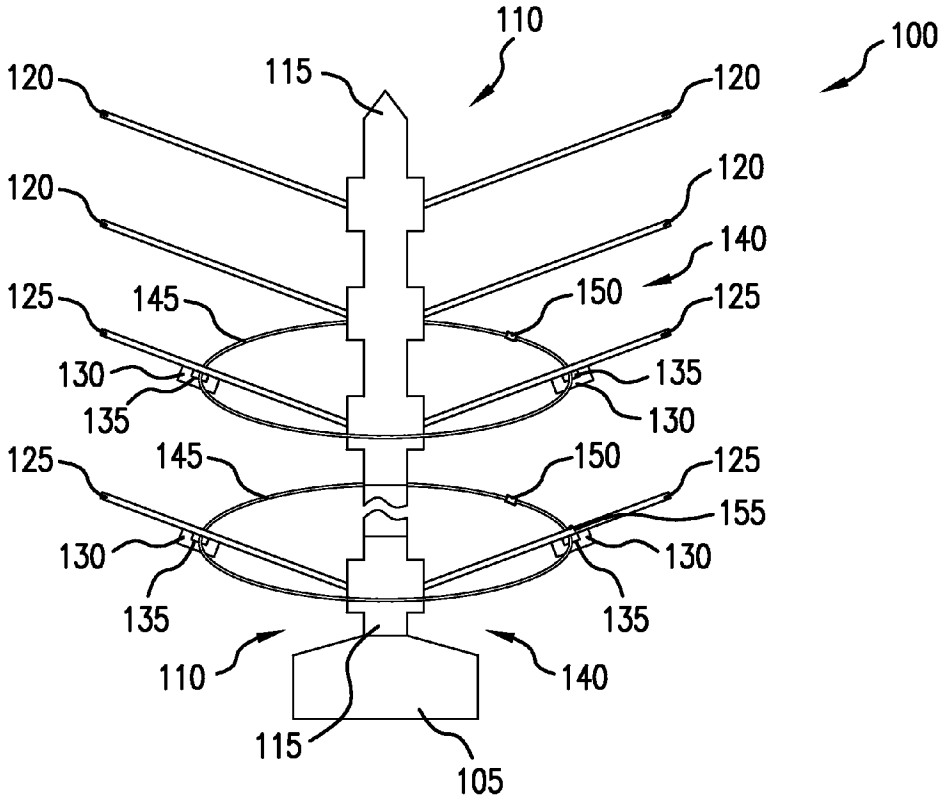
FIG. 1A depicts an exemplary artificial tree apparatus in a deployed position.

FIG. 1A depicts an exemplary artificial tree apparatus in a deployed position. An artificial tree apparatus 100 may be maneuvered to a deployed position, such as during use, or a stowed position, such as during storage or periods of nonuse. In an exemplary embodiment, the artificial tree apparatus 100 may be shaped in the form of a holiday or Christmas tree. The artificial tree apparatus 100 may be formed in variety of heights, such as for example 4, 5, 6, 7, or 8 feet. Likewise, the artificial tree apparatus 100 may be formed in a variety of widths, such as for example 3, 4, or 5 feet. The artificial tree apparatus 100 has a greater width in the deployed position than in the stowed position as is evident from the Figures.

The artificial tree apparatus 100 includes a base 105 for providing self-standing upright support of the artificial tree apparatus 100. In some embodiments, the base 105 may be secured rigidly to a floor surface. In other exemplary embodiments, the base 105 may be movable along the floor surface.

Extending vertically from the base 105 are a plurality of tree segments 110. In an exemplary embodiment, mating tree segments 110 may be removably connected to each other. The number of tree segments 110 may depend upon the overall height preference of the artificial tree apparatus 100. For example, 2-3 tree segments 110 may be used in an artificial tree apparatus 100 of lesser height and 5-6 tree segments 110 may be used in an artificial tree apparatus 100 of a greater height. In some exemplary embodiments, the length of each tree segment 110 may be the same. In other exemplary embodiments, the length of one or more tree segments 110 may be different. In other exemplary embodiments, a one-piece tree segment 110 may extend from the base 105 to a top of the artificial tree apparatus 100.

Each tree segment 110 includes a trunk segment 115 and a plurality of branch segments 120, 125. The trunk segment 115 encompasses the central or axial portion of the tree segment 110 extending vertically from the base 105. The branch segments 120, 125 are movably connected to the trunk segment 115 such as to permit the branch segments 120, 125 to move from the deployed position to the stowed position. The branch segments 120, 125 may include artificial needles or leaves to mimic a real tree. Each branch segment 120, 125 includes a proximal end adjacent the trunk segment 115 and a distal end opposite the trunk segment 115.

In the depicted example, the branch segments 120, 125 are in a first position where the distal end of each common layer of branch segments 120, 125 is positioned in a first common horizontal plane. As exemplified in reference to FIG. 1B, the branch segments 120, 125 are in a second position where the distal end of each common layer of branch segments 120, 125 is positioned in a second common horizontal plane. In an exemplary embodiment, the second common horizontal plane is at a higher elevation than the first common horizontal plane with reference to the trunk segment 115.

Each particular layer includes branch segments 120, 125 located at common elevations. For example, a first set of branch segments 120, 125 having proximal ends located within a first common horizontal plane may be within a first layer of branch segments 120, 125. A second set of branch segments 120, 125 having proximal ends located within a second common horizontal plane may be within a second layer of branch segments 120, 125, where the first common horizontal plane is different than the second common horizontal plane. For example, the first common horizontal plane may be below or lower than the second common horizontal plane. Likewise, branch segments 120, 125 having distal ends within common horizontal planes are within a common layer. The horizontal planes may be perpendicular to a vertical axis of the trunk segment 115, for example.

Each tree segment 110 may include one or more layers of passive branch segments 120 in addition to a layer of control branch segments 125. In the depicted example, the upper tree segment 110 includes two layers of passive branch segments 120 and one layer of control branch segments 125. In other exemplary embodiments, more or less passive branch segment 120 layers may be associated with more or less control branch segment 125 layers. In other exemplary embodiments, each layer may be control branch segments 125. In still other exemplary embodiments, each layer may be passive branch segments 120 where a lower tree segment 110 has at least one layer of control branch segments 125. As exemplified and further discussed in reference to FIG. 1B, the control branch segments 125 are directly caused to pivot inwardly which then cause the passive branch segments 120 to pivot inwardly via forcible contact from the control branch segments 125.

The artificial tree apparatus 100 includes a control member guide 130 extending from each of the control branch segments 125. The control member guide 130 may be integrally formed with the control branch segment 125, examples of which are described with reference to FIGS. 3A-3B. In other exemplary embodiments, the control member guide 130 may be removably connected to the control branch segments 125, examples of which are described with reference to FIG. 4. In an exemplary embodiment, a plurality of control member guides 130 may be connected to any suitable artificial or real tree having movable branch segments 120, 125 to provide a structure for moving and retaining the branch segments 120, 125 of the artificial or real tree in a stowed position.

In the depicted example, the control member guides 130 extend beneath each control branch segment 125. In other exemplary embodiments, the control member guides 130 may extend above each control branch segment 125.

The control member guide 130 may extend from the control branch segment 125 at various locations along the length of the control branch segment 125. For example, the control member guides 130 may extend from a midway point along the control branch segments 125. In another exemplary embodiment, the control member guides 130 may extend from the control branch segments 125 adjacent the proximal end of the control branch segments 125, such as approximately 20-40% along the length of the control branch segments 125, examples of which are described with reference to FIG. 3B. In another exemplary embodiment, the control member guides 130 may extend from the control branch segments 125 adjacent the distal end of the control branch segments 125, such as approximately 60-80% along the length of the control branch segments 125, examples of which are described with reference to FIG. 4.

In an exemplary embodiment, each set of control member guides 130 within a layer of control branch segments 125 extend from the control branch segment 125 at a common radius relative the trunk segment 115. For example, if a first control member guide 130 is attached midway along the length of the control branch segment 125, then all control member guides 130 in the same layer may be attached midway along the length of the respective control branch segment 125.

Each control member guide 130 includes an aperture 135 for receiving a control member 140. In an exemplary embodiment, a single control member 140 is associated with an entire layer of control branch segments 125. For example, as exemplified in the depicted example, the control member 140 encircles the trunk segment 115 and is routed through each control member guide 130 within a common layer of the control branch segments 125. In an exemplary embodiment, the control member 140 is positioned within a common horizontal plane of the control member guides 130 that the control member 140 is routed through.

The control member 140 includes a body 145, an eye 150, and a securing apparatus 155. The body 145 is formed of an elongated structure suitable for extending through the apertures 135 of the control member guides 130. The body 145 is formed of a material having a suitable strength to cinch the connected branch segments 120, 125 toward a connected trunk segment 115. In the depicted example, the body 145 includes a first end having an eye 150 and a second free end having a securing apparatus 155. The free end is routed through the eye 150 to encircle the respective trunk segment 115. The securing apparatus 155 may be formed in a hook-type structure for retaining the control member 140 in a cinched or reduced diametric position, such as when the branch segments 120, 125 are pivoted to the stowed position. In an exemplary embodiment, the control member guide 130 and control member 140 may be colored to blend with the artificial tree apparatus 100, such as for example being colored green to match artificial pine needles.

Figure 1B:
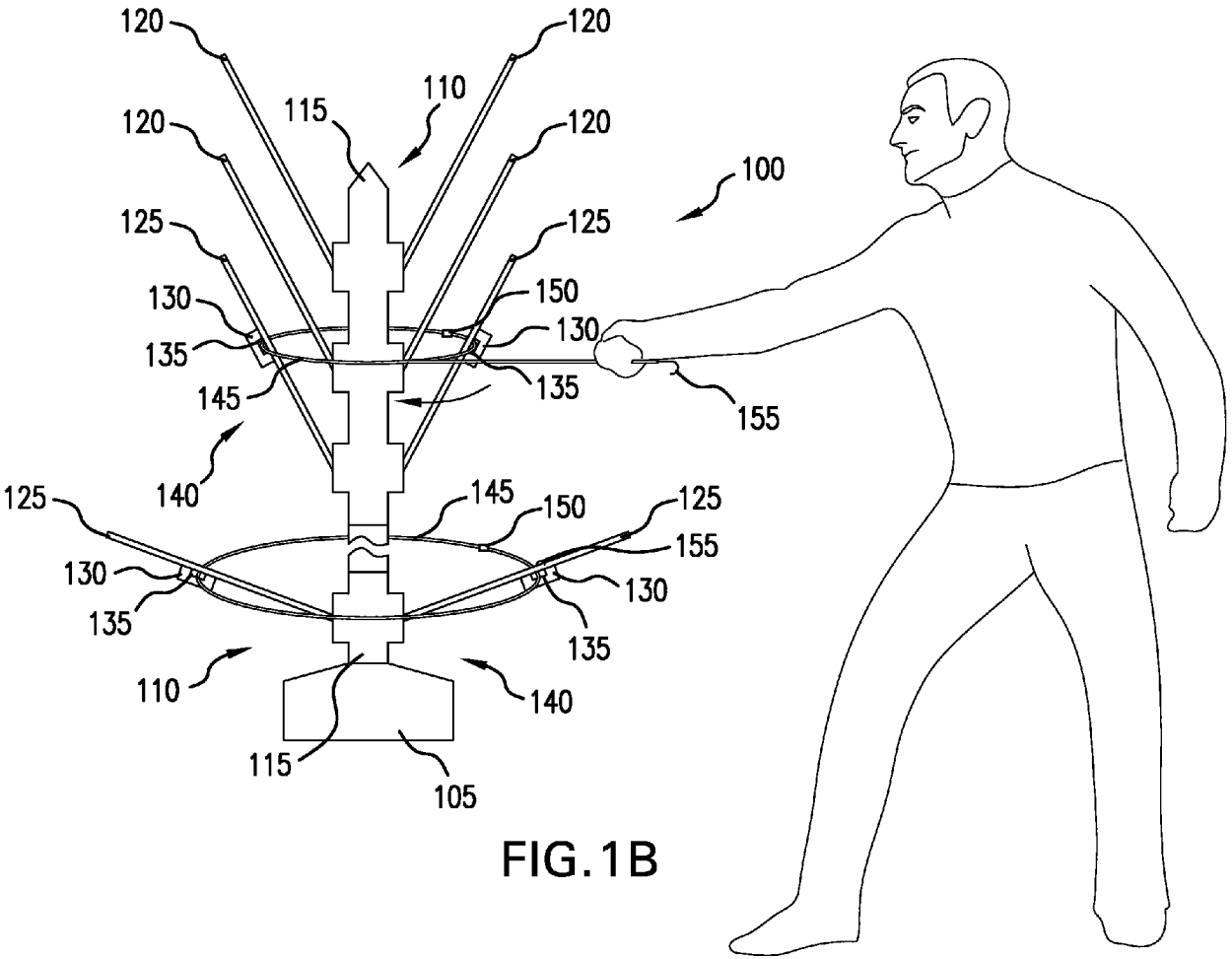
FIG. 1B depicts an exemplary artificial tree apparatus in a stowed position.

FIG. 1B depicts an exemplary artificial tree apparatus in a stowed position. In the depicted example, the branch segments 120, 125 are directed towards the second position such as to elevate the distal ends of the branch segments 120, 125 and decrease the radius of the control member guides 130 from the respective trunk segment 115. To move the branch segments 120, 125 to the stowed position, the free end of control member 140 is pulled outwardly away from the eye 150 which then reduces a diameter of the encircling portion of the body 145 of the control member 140 (e.g., cinches the control member 140). As the diameter of the encircling portion is reduced the control member guides 130 are forced to move inwardly with the body 145 which cause the control branch segments 125 to pivot inwardly and upwardly. As the control branch segments 125 pivot inwardly and upwardly, the control branch segments 125 engage the passive branch segments 120 and forcible cause the passive branch segments 120 to pivot inwardly and upwardly along with the control branch segments 125.

When the branch segments 120, 125 reach an acceptable stowed position, the securing apparatus 155 of the control member 140 is wrapped around the branch segments 120, 125 along the body 145 of the control member 140 and hooked on a suitable aperture 135 of the control member 140 to retain the body 145 of the control member 140 in a current diametric position and thus retain the branch segments 120, 125 in the stowed position. A similar process is repeated for each layer of control branch segments 125. In an exemplary embodiment of the branch segments 120, 125 pivoting inwardly and upwardly towards a stowed position, the lowermost layer of branch segments 120, 125 is structured as control branch segments 125.

Figure 2A:
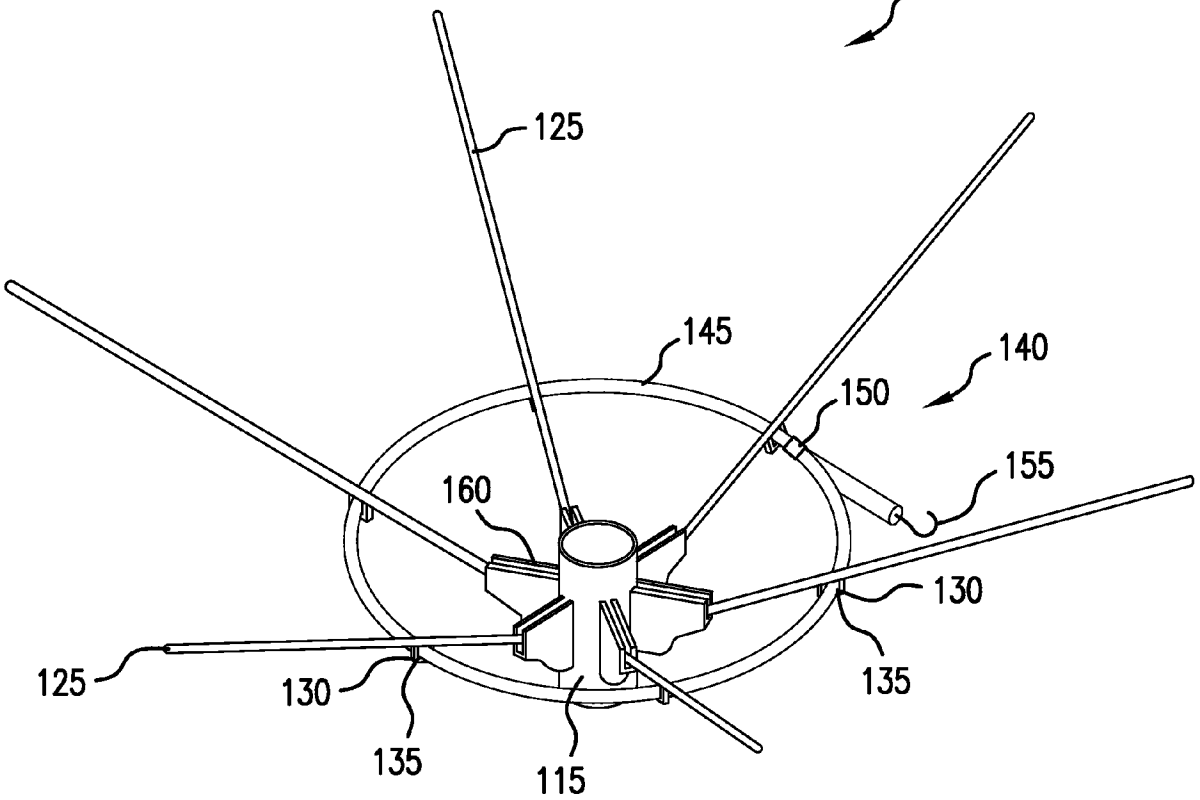
FIG. 2A depicts an exemplary tree segment in a deployed position.
Figure 2B:
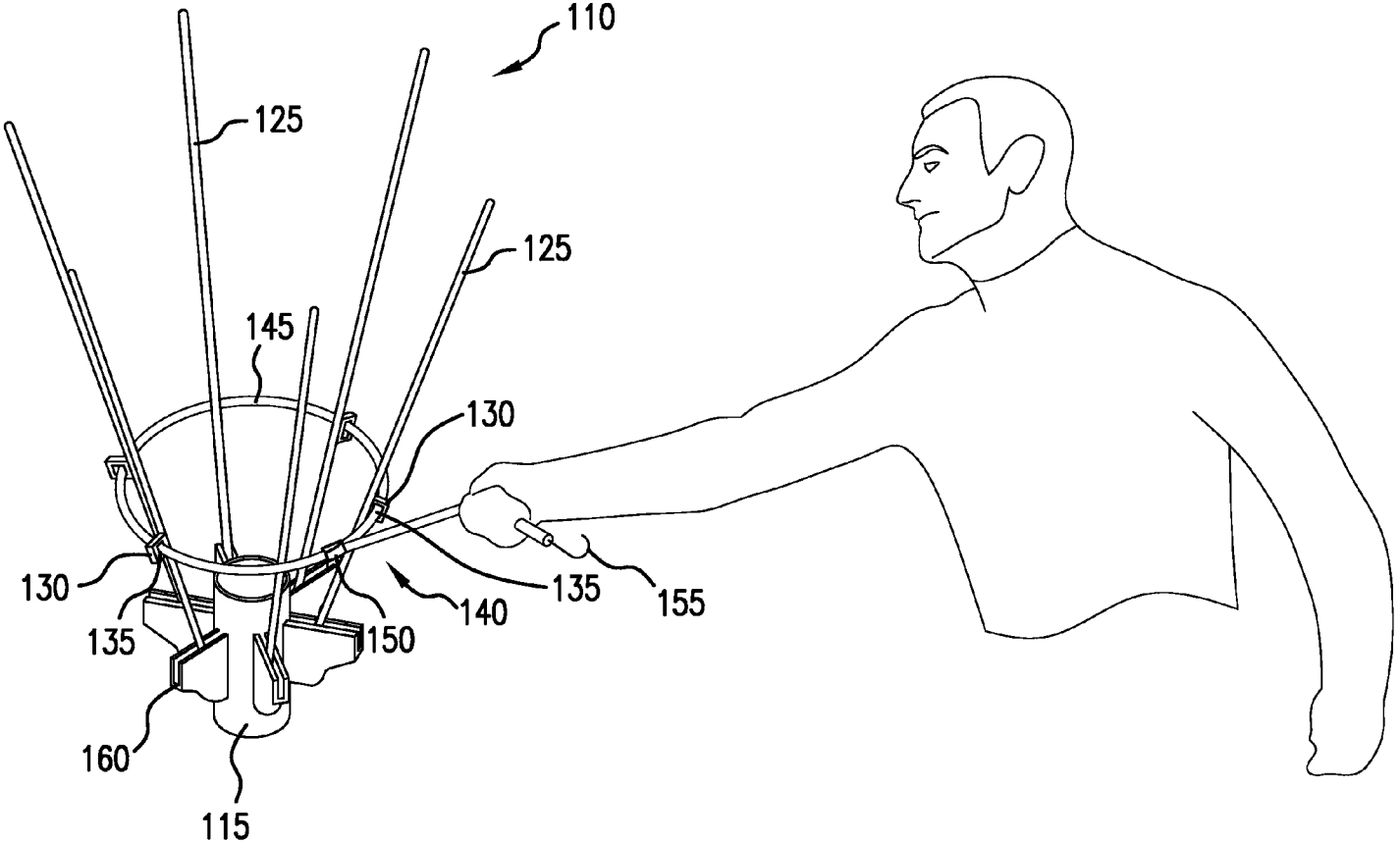
FIG. 2B depicts an exemplary tree segment in a stowed position.

FIG. 2A depicts an exemplary tree segment in a deployed position and FIG. 2B depicts an exemplary tree segment in a stowed position. In the depicted example, the tree segment 110 includes a trunk segment 115 and a single layer of control branch segments 125. The control branch segments 125 are moved from a deployed position as illustrated in FIG. 2A to a stowed position as illustrated in FIG. 2B. The tree segment 110 includes a plurality of hinge structures 160 for pivotally connecting the branch segments 125 to the trunk segment 115. In an exemplary embodiment, the hinge structure 160 may be a pin and hole mating structure. In other exemplary embodiments, the hinge structure 160 may be ratcheting structure.

Figure 3B:
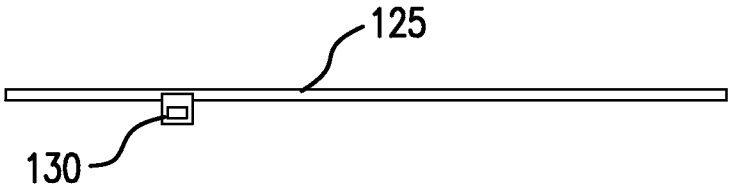
FIGS. 3A-3B depict an exemplary control member guide formed in a branch segment.
Figure 3A:
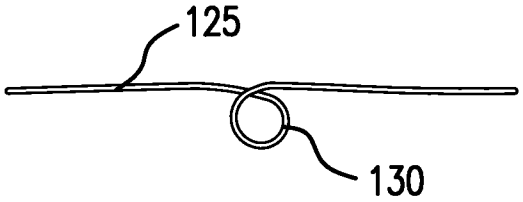

FIGS. 3A-3B depict an exemplary control member guide formed in a branch segment. The branch segment 125 may be formed with an integral control member guide 130. In the depicted example, a loop having the function of the control member guide 130 is formed in the branch segment 125 during a manufacturing process.

In an exemplary embodiment, the branch segment 125 is a metal rod at the time in which the loop is formed therein. In the depicted example, the branch segment 125 and integral control member guide 130 may then be coated with a covering material, such as for example plastic or polyvinyl chloride. In another exemplary embodiment, the covering material may be Teflon® manufactured by DuPont Co. In an exemplary embodiment, artificial tree needles or leaves may then be attached to the branch segment 125 and integral control member guide 130. In the depicted example, the control member guides 130 extend from the control branch segments 125 adjacent the proximal end of the control branch segments 125, such as approximately 20-40% along the length of the control branch segments 125.

Figure 4:
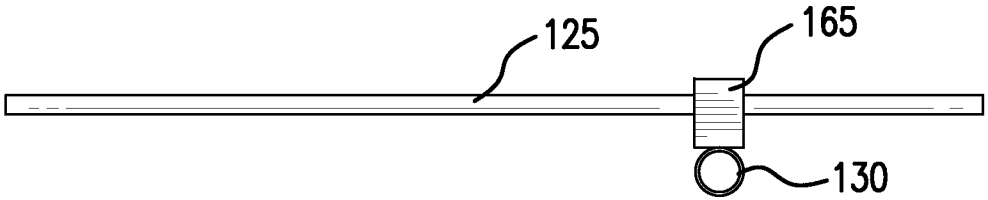
FIG. 4 depicts an exemplary control member guide connected to a branch segment.
Figure 5:
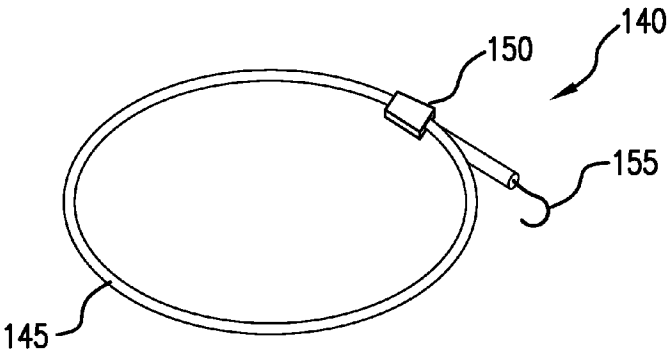
FIG. 5 depicts a first exemplary control member.

FIG. 4 depicts an exemplary control member guide connected to a branch segment. The control member guide 130 may connected to the control branch segment 125 after production of the control branch segment 125. In the depicted example, the control member guide 130 includes an attachment member 165 for securing the control member guide 130 to an existing branch segment 125. In an exemplary embodiment, the attachment member 165 may be an operable clip. In another exemplary embodiment, the attachment member 165 may be a clamp or clasp. In yet another exemplary embodiment, the attachment member 165 may be a magnet to magnetically attach to the branch segment 125.

The control member guide 130 may attach to any suitable artificial or real tree having movable branch segments 125 to provide a structure for moving and retaining the branch segments 125 of the artificial or real tree in a stowed position. The control member guide 130 may also be attached to the branch segment 125 along any lengthwise portion of the branch segment 125. In the depicted example, the control member guides 130 may extend from the control branch segments 125 adjacent the distal end of the control branch segments 125, such as approximately 60-80% along the length of the control branch segments 125.

FIG. 5 depicts a first exemplary control member. In the depicted example, the control member 140 has an elongated body 145 with an eye 150 at one end and a securing apparatus 155 at an opposing, free end. The securing apparatus 155 is directed through the eye 150 to form a circular shape along the body 145. As the securing apparatus 155 is pulled away from the eye 150, the body 145 is contracted or reduced in diameter, such as to cinch the branch segments 120, 125, for example. The securing apparatus 155 may be formed in the shape of a hook to be secured on a branch segment 125 and/or control member guide 130 to retain the body 145 in the preferred diametric size. To enlarge the diameter, such as to release the branch segments 120, 125 to the first or deployed position, the securing apparatus 155 may be simply removed from the attached branch segment 125 or control member guide 130.

FIG. 6 depicts a second exemplary control member. In the depicted example, the control member 140 has an elongated body 145 with an eye 150 at one end and a securing apparatus 155 along the same end as the eye 150. The opposing free end of the body 145 is directed through the eye 150 and along the securing apparatus 155. The securing apparatus 155 is formed in the shape of a ratchet to engage teeth along the length of the body 145. In the depicted example, the control member 140 may be in the shape of a plastic zip tie. As the free end is pulled away from the eye 150, the body 145 is contracted or reduced in diameter. To enlarge the diameter, such as to release the branch segments 120, 125 to the first or deployed position, the securing apparatus 155 may be pivoted or moved to cause the securing apparatus 155 to release from the teeth of the body 145.

FIG. 7 depicts a third exemplary control member. In the depicted example, the control member 140 has an elongated body 145 with an eye 150 at one end and a free end. The securing apparatus 155 is located between the eye 150 and the free end and serves to control a diametric size of the body 145 around the branch segments 120, 125. In the depicted example, the securing apparatus 155 is formed of a spring-loaded clasp.

Figure 8:
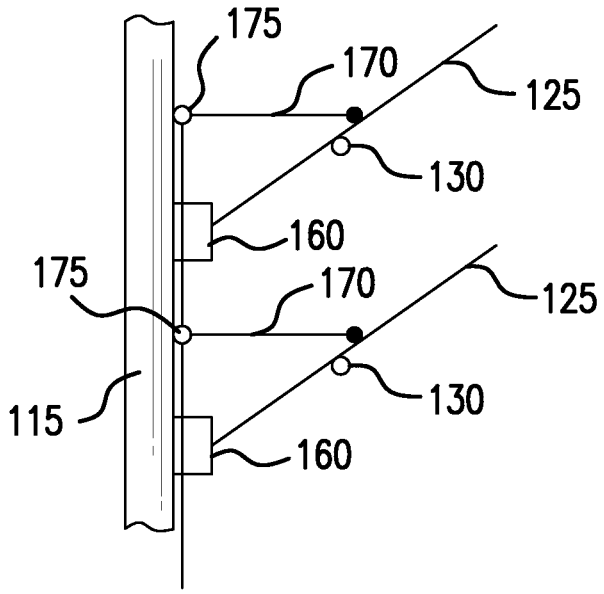
FIG. 8 depicts an exemplary artificial tree apparatus in a deployed position.

FIG. 8 depicts an exemplary artificial tree apparatus in a deployed position. In the depicted example, a non-encircling control member 170 is used to move the branch segments 125 between the deployed position and the stowed position. The control member 170 is routed through one or more eyelets 175 along the trunk segment 115 and has a first end attached to the branch segment 125 and a second end extending towards a lower end of the trunk segment 115. Each eyelet 175 may be located within a common horizontal plane as an attachment point of the first end of the control member 170 to the respective branch segment 125. As the second end of the control member 170 is pulled downwards, the first end of the control member 170 pulls inwardly on the branch segment 125 towards the trunk segment 115 to move the branch segment 125 from the deployed position to the stowed position.

In an exemplary embodiment, the second end of the control member 170 may be secured in place to retain the branch segments 125 in the stowed position. In some exemplary embodiments, each branch segment 125 may include a control member 170. In other exemplary embodiments, multiple control members 170 may be connected together, such that a user is only required to pull downwards on one control member 170 to move all of the branch segments 125 toward the stowed position. Similar to the control member guides 130, the attachment point of the first end of the control member 170 may be located at various lengthwise portions along the branch segment 125.

Although various embodiments have been described with reference to the Figures, other embodiments are possible. For example, an artificial tree apparatus may include a control member threaded through control member guides connected to each hinged branch segment in a layer of branch segments, such that by pulling on the control member or making an adjustment of the control member, all of the branch segments in the layer are hinged inwardly towards a storage or stowed position. Likewise, releasing the control member or making another adjustment of the control member from a cinched position may cause the branch segments to hinge downwardly to a deployed position. In an exemplary embodiment, a given layer of control branch segments may cause one or more layers of branch segments (e.g., passive branch segments) above the control branch segments to also hinge inwardly to the stowed position due to forcible contact with the control branch segments.

In accordance with another embodiment, a handle may attach to the free end of the control member to permit easy pulling of the free end and cinching of the control member. For example, the handle may be formed in the shape of a finger pull. In another exemplary embodiment, the handle may be removable from the free end and interchangeable with a securing apparatus. In another exemplary embodiment, the handle may include a securing apparatus.

In various embodiments, the control member may advantageously be constructed to have a low friction interface with each of the guides or any other contact points. For example, the control member may be coated with a covering material, such as for example plastic or polyvinyl chloride. In another exemplary embodiment, the covering material may be Teflon® manufactured by DuPont Co.

In accordance with another embodiment, the control member is reusable, such as for example to permit for the branch segments to be moved from the deployed position to the stowed position and back to the deployed position while using the same control member. In other exemplary embodiments, the control member may be configured for one-time use, such as for example a zip tie having a non-releasing securing mechanism. The control member may be configured to permit excess portions of the body, such as along the free end, to be cut or removed, such as when the branch segments are in the stowed position and the control member is configured for one-time use operation.

In accordance with an exemplary embodiment, the body of the control member may be formed of various structures or materials. For example, the body of the control member may be formed of an elastic rope. In another exemplary embodiment, the body of the control member may be formed of a plastic strap. In another exemplary embodiment, the body may be formed of a fabric belt or strap. Other exemplary embodiments may utilize a string, cord, or cable as the body of the control member.

A number of implementations have been described. Nevertheless, it will be understood that various modification may be made. For example, advantageous results may be achieved if the steps of the disclosed techniques were performed in a different sequence, or if components of the disclosed systems were combined in a different manner, or if the components were supplemented with other components. Accordingly, other implementations are within the scope of the following claims.

What is claimed is:

1. An artificial tree apparatus, comprising:

a trunk segment;

a plurality of branch segments movably connected to said trunk segment, wherein said plurality of branch segments each have a proximal end adjacent said trunk segment and a distal end opposite said trunk segment, wherein said plurality of branch segments are movable relative said trunk segment to a first position and a second position; and a plurality of control member guides extending from said plurality of branch segments between said proximal end and said distal end, wherein each of said plurality of control member guides includes an aperture, wherein, for a set of branch segments connected to said trunk segment at a single elevation, each of the plurality of control member guides is located at a first common elevation in said first position and wherein each of the plurality of control member guides is located at a second common elevation in said second position;

wherein, for a set of branch segments connected to said trunk segment at a single elevation, each of the control member guides is adapted to receive a control member routed through their apertures, said control member having an encircling portion and an excess portion, wherein, when the control member is routed through the apertures, the entirety of the encircling portion encircles said trunk segment within a horizontal plane common to the control member guides, and wherein each of the branch segments of said set of branch segments is adapted to simultaneously adjust to said first position in response to a first adjustment of said control member and is adapted to simultaneously adjust to said second position in response to a second adjustment of said control member; and wherein, when the control member is routed through the apertures, pulling the excess portion of the control member causes a diameter of the encircling portion to decrease.

2. The apparatus of claim 1, wherein said plurality of branch segments are hingedbly connected to said trunk segment.

3. The apparatus of claim 1, wherein said plurality of branch segments are ratchetably connected to said trunk segment.

4. The apparatus of claim 1, wherein said plurality of control member guides are integrally formed with said plurality of branch segments.

5. The apparatus of claim 1, wherein said plurality of control member guides are removably connected to said plurality of branch segments.

6. The apparatus of claim 1, wherein said plurality of control member guides are mechanically coupled to said plurality of branch segments.

7. The apparatus of claim 1, wherein said plurality of control member guides extend from said plurality of branch segments at a substantial longitudinal center of said plurality of branch segments.

8. The apparatus of claim 1, wherein said plurality of control member guides extend from said plurality of branch segments adjacent said proximal end of said plurality of branch segments.

9. The apparatus of claim 1, wherein said plurality of control member guides extend from said plurality of branch segments adjacent said distal end of said plurality of branch segments.

10. The apparatus of claim 1, wherein said first common elevation is lower than said second common elevation relative said trunk segment.

11. The apparatus of claim 1, wherein each of said plurality of control member guides is located at a first common radius relative said trunk segment in said first position and wherein each of said plurality of control member guides is located at a second common radius relative said trunk segment in said second position.

12. The apparatus of claim 11, wherein said second radius is less than said first radius.

* * * * *